US006238323B1

(12) United States Patent
Simonson

(10) Patent No.: US 6,238,323 B1
(45) Date of Patent: May 29, 2001

(54) CABLE CROSSOVER EXERCISE APPARATUS

(75) Inventor: Roy Simonson, Colorado Springs, CO (US)

(73) Assignee: The Simonson Family Limited Partnership RLLLP, Colorado Springs, CO (US)

( * ) Notice: Subject to any disclaimer, the term of this patent is extended or adjusted under 35 U.S.C. 154(b) by 0 days.

(21) Appl. No.: 09/395,194

(22) Filed: Sep. 14, 1999

(51) Int. Cl.[7] ..... A63B 21/062
(52) U.S. Cl. ..... 482/103; 482/102; 482/138
(58) Field of Search ..... 482/99, 102, 103, 482/133, 13; D21/673, 675

(56) References Cited

U.S. PATENT DOCUMENTS 776,824 * 12/1904 Bryon ..... 482/103
4,826,157 * 5/1989 Fitzpatrick ..... 482/103
5,800,321 * 9/1998 Webber ..... 482/103

FOREIGN PATENT DOCUMENTS

1743620 * 6/1992 (SU) ..... 482/102

* cited by examiner

*Primary Examiner*—John Mulcahy
(74) *Attorney, Agent, or Firm*—Hoffman Wasson & Gitler PC

(57) ABSTRACT

A highly versatile exercise apparatuses is disclosed. More particularly, the invention relates to a cable crossover exercise apparatus including a central weight stack and opposed extension arms. The invention also relates to a functional lift exercise apparatus including a central weight stack and substantially parallel extension arms. The invention further relates to a cable type exercise apparatus employing a pulley assembly with a 4:1 load ratio.

20 Claims, 7 Drawing Sheets

CABLE CROSSOVER EXERCISE APPARATUS

BACKGROUND OF THE INVENTION

1. Field of the Invention

The invention relates to highly versatile exercise apparatuses. More particularly, the invention relates to a cable crossover exercise apparatus including a central weight stack and opposed extension arms. The invention also relates to a functional lift exercise apparatus including a central weight stack and substantially parallel extension arms. The invention further relates to a cable type exercise apparatus employing a pulley assembly with a 4:1 load ratio.

2. Description of the Prior Art

The prior art of exercise apparatuses is replete with multipurpose machines providing users with a variety of possible exercising positions. Unfortunately, the majority of these exercise apparatuses are large, cumbersome and difficult to utilize.

Those skilled in the art will, therefore, appreciate the need for a compact, easy-to-use exercise apparatus which provides users with a variety of possible exercise positions. The present invention provides such an exercise apparatus.

In addition, these exercise apparatuses commonly employ a weight stack actuated by a cable which is pulled by users of the apparatus. Such arrangements present significant limitations affecting the usefulness of the exercise apparatus. For example, the range of exercises which may be performed with such cable actuated apparatuses is sometimes limited by the effective length of cable linking the weight stack with the user. In most instances, the effective useful length of the cable is limited by the height of the weight stack; that is, for each foot the cable is pulled by the user, the weight stack must rise a proportional distance. Where the rise of the weight stack is substantially equal to the distance which the cable is pulled, the effective useful length of the cable is limited to only a few feet since building weight stacks any larger would be cost prohibitive, as well as structurally undesirable.

Weight stack based exercise apparatuses also encounter problems as a result of the momentum created when the weight plates are lifted under the control of a cable. Specifically, when the weight plates are lifted upwardly at a fast pace, the generated momentum creates momentary reductions and increases in the perceived force encountered by the user of the exercise apparatus. Such momentary changes are highly undesirable.

As a result, a need further exists for an exercise apparatus overcoming the shortcomings of prior art cable assemblies. The exercise apparatus should provide an extended length of effective cable and reduce the undesirable effects of momentum created as the weight plates are moved up and down within the weight stack. The present invention provides such an exercise apparatus.

SUMMARY OF THE INVENTION

It is, therefore, an object of the present invention to provide an exercise apparatus including a resistance assembly and a cable linking a first extension arm and a second extension arm to the resistance assembly. The first extension arm includes a first end selectively supported adjacent the resistance assembly and a free second end from which the first strand of the cable system extends for engagement by a user. Similarly, the second extension arm includes a first end selectively supported adjacent the resistance assembly and a free second end from which the first strand of the cable system extends for engagement by a user. The first extension arm extends away from the second extension arm, moving the second end of the first extension arm away from the second end of the second extension arm to define an extended opposed spacing of the first and second strands.

It is also an object of the present invention to provide an exercise apparatus wherein the first extension arm and the second extension are substantially parallel as they extend from the resistance assembly.

It is still a further object of the present invention to provide an exercise apparatus wherein the cable passes over a series of pulleys which create a 4:1 load ratio for each user handle.

Other objects and advantages of the present invention will become apparent from the following detailed description when viewed in conjunction with the accompanying drawings, which set forth certain embodiments of the invention.

DESCRIPTION OF THE PREFERRED EMBODIMENTS

The detailed embodiments of the present invention are disclosed herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

Figure 1:
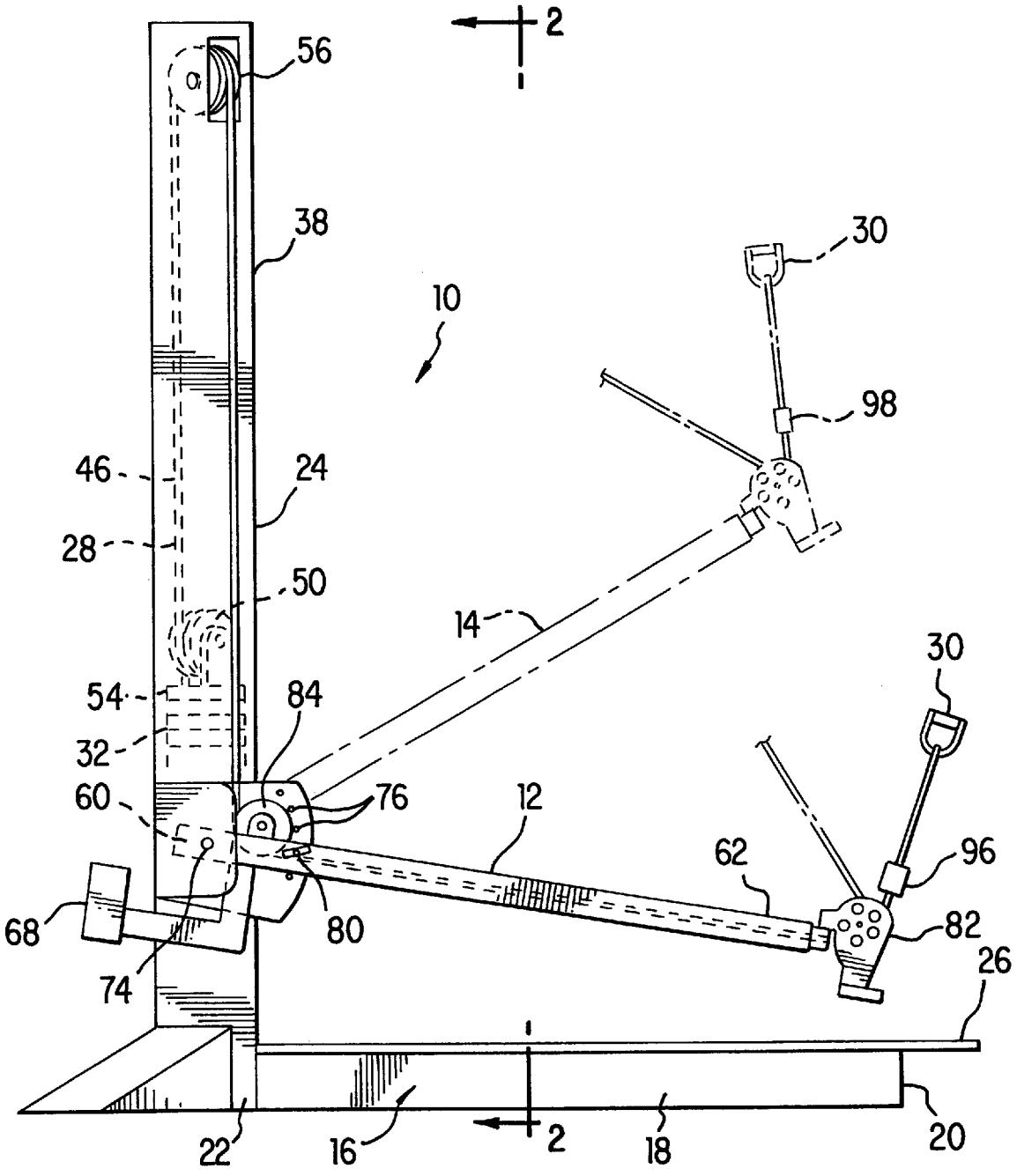
FIG. 1 is a side view of the functional lift exercise apparatus in accordance with the present invention.
Figure 3:
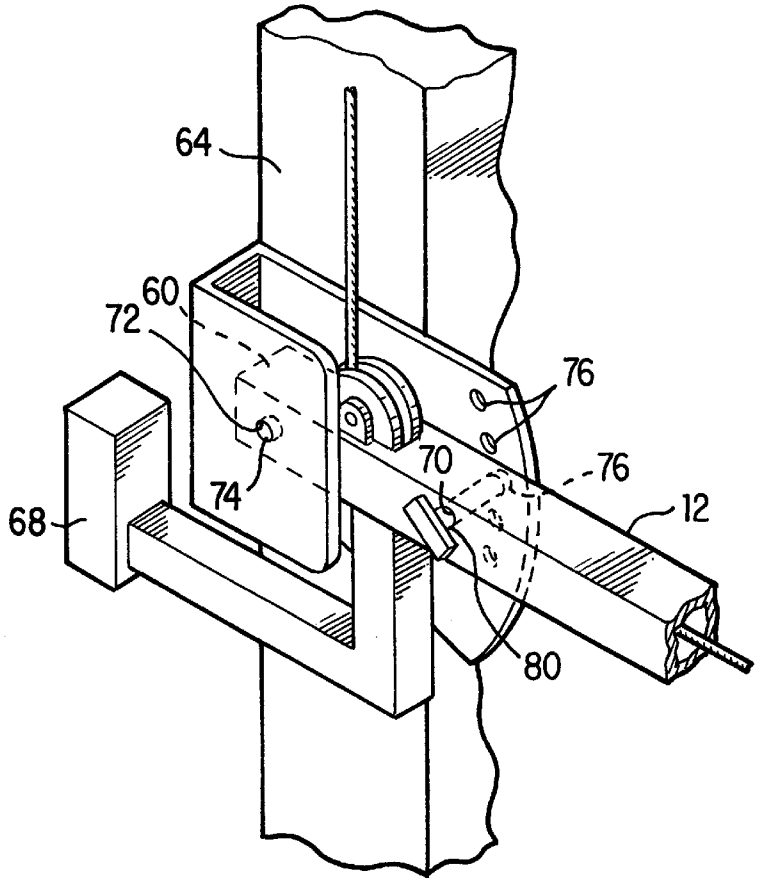
FIG. 3 is a detailed perspective view of the first end of the extension arm.
Figure 2:
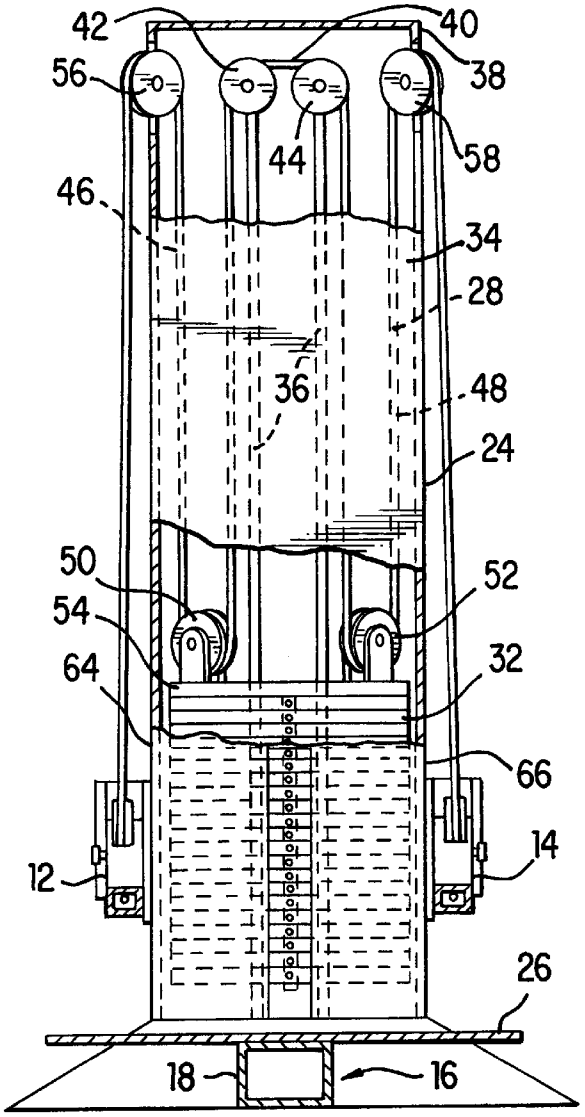
FIG. 2 is a cross sectional view of the functional lift exercise apparatus along the line 2—2 in FIG. 1 with the weight stack shown in partial cross section.

With reference to FIGS. 1 to 3, a functional lift exercise apparatuses 10 is disclosed. The functional lift exercise apparatus 10 includes a pair of parallel extension arms 12, 14 positioned to facilitate a wide range of lifting type exercises.

The functional lift exercise apparatus 10 further includes a base structure 16 having a central user support member 18 with a free first end 20 and a second end 22 to which a weight stack 24 is secured. Between the first end 20 and the second end 22, the central user support member 18 includes a platform 26 sized, shaped and constructed to support a standing user while he or she operates the present functional lift 10. The base structure 16, as well as the remaining structural components of the exercise apparatus 10, are preferably formed from steel, although other materials may also be used without departing from the spirit of the present invention.

A single cable 28 links the user handles 30 with the weight stack 24. The cable 28 is run through a series of pulleys to provide a 4:1 load ratio for each handle 30. In this way, a four hundred pound stack of weight plates 32 may be moved by the application of one hundred pounds force at each handle 30 of the functional lift 10 (two hundred pounds total force when both handles are used simultaneously).

The 4:1 ratio reduces the inertia of the weight plates 32 by reducing the rate of movement of the weight plates 32 compared to the rate of travel at the handle 30. Single hand movements allow the handle 30 to move four times faster than the weight plates 32 and dual hand movement allows the handles 30 to move twice the speed of the weight plates 32.

The 4:1 ratio also provides single hand movements equal in length to four times the travel distance of the weight plates 32. This allows extended movements, such as, for example, overhead lift and bicep curls in addition to the dead lift movements, to provide users with greater flexibility in choosing a desired resistance level.

Referring specifically to FIG. 2, the weight stack 24 includes a support frame 34 with vertical support members 36 aligned to support the stack of weight plates 32. The weight plates 32 are supported for movement up and down in a conventional manner. In fact, the pulley system, which is discussed below in greater detail, is used to lift the weight plates 32. The weight stack 24 is covered by a protective sleeve 38 positioned thereabout.

As briefly discussed above, a single cable 28 actuates the weight stack 24 and controls the movement of the weight plates 32. The central portion 40 of the cable 28 is passed over first and second central upper pulleys 42, 44. The central upper pulleys 42, 44 are positioned adjacent the upper end of the weight stack 24, although the exact positioning of the central upper pulleys 42, 44 may be varied without departing from the spirit of the present invention.

Opposite strands 46, 48 of the cable 28 then extend downwardly within the weight stack 24 to respectively engage first and second movement pulleys 50, 52. The movement pulleys 50, 52 are attached to a coupling member 54 directly attached to the stack of weight plates 32. In this way, upward movement of the movement pulleys 50, 52 causes the coupling member 54 to move upwardly, and ultimately lift the weight plates 24 against the force of gravity.

The first and second strands 46, 48 then extend upwardly and respectively pass over first and second exit pulleys 56, 58. After passing over the exit pulleys 56, 58, and exiting the confines of the weight stack 24, the opposite strands 46, 48 extend downwardly until they enter the first and second extension arms 12, 14. Although a preferred orientation is disclosed for the various pulleys used in accordance with the present invention, those skilled in the art will readily understand that the exact orientation of the pulleys may be varied without departing from the spirit of the present invention.

The first and second extension arms 12, 14 are pivotally coupled to the base portion of the weight stack 24 and extend outwardly toward the central user support member 18, that is, parallel to the central user support member 18. Each extension arm 12, 14 pivots about a pivot axis and the pivot axes of the first and second extension arms 12, 14 are substantially aligned.

The first and second extension arms 12, 14 are substantially identical and will now be described with reference to the first extension arm 12. Referring to FIGS. 1 and 3, the first extension arm 12 includes a first end 60 and a second end 62. The first extension arm 12 is pivotally coupled, at a position near the first end 60 of the extension arm 12, to a first side 64 of the weight stack 24 adjacent the base of the weight stack 24 (the second extension arm 14 is pivotally coupled to the opposite second side 66 of the weight stack 24). In fact, the first extension arm 12 is pivotally coupled in a manner allowing a user to select a desired orientation for the first extension arm 12 relative to the weight stack 24 and to lock the extension arm 12 in place. Movement of the first extension arm 12 is controlled by the inclusion of a counterweight 68 at the first end 60 of the first extension arm 12.

With reference to FIG. 3, the first extension arm 12 includes a locking hole 70. The locking hole 70 is located adjacent a pivot hole 72 through which a pivot pin 74 passes to pivotally couple the first extension arm 12 to the weight stack 24. The locking hole 70 is aligned with a series of flange holes 76 formed on a semicircular flange 78 of the weight stack 24. The semicircular flange 78 is positioned substantially parallel to the plane in which the first extension arm 12 rotates as it moves relative to the weight stack 24.

In practice, and as those skilled in the art will readily appreciate, a locking pin 80 is passed though an aligned locking hole 70 and flange hole 76 to lock the extension arm 12 at a desired angular orientation relative to the weight stack 24. When a user desires to change the angular orientation of the first extension arm 12, the locking pin 80 is simply removed and the locking hole 70 is aligned with another flange hole 76 at which time the locking pin 80 is once again inserted in position to lock the first extension arm 12 relative to the weight stack 24.

The second end 62 of the first extension arm 12 is fitted with a pivoting pulley 82 which guides the first strand 46 of the cable 28 as it exits the first extension arm 12. With reference to the prior discussion regarding the pulley assembly employed in accordance with the present invention, once the first strand 46 of the cable 28 passes over the exit pulley 56 and moves downwardly into engagement with the extension arm 12, the first strand 46 passes over a guide pulley 84 located at the first end 60 of the first extension arm 12. The first strand 46 of the cable 28 passes over the first guide pulley 84 and enters the tubular passageway formed in the first extension arm 12.

Upon reaching the second end 62 of the first extension arm 12, the first strand 46 passes over the pivoting pulley 82 and is ready for engagement by a user of the present apparatus. The distal end of the first strand 46 of the cable 28 may be fitted with a wide variety of handles 30 known to those skilled in the art.

Figure 4:
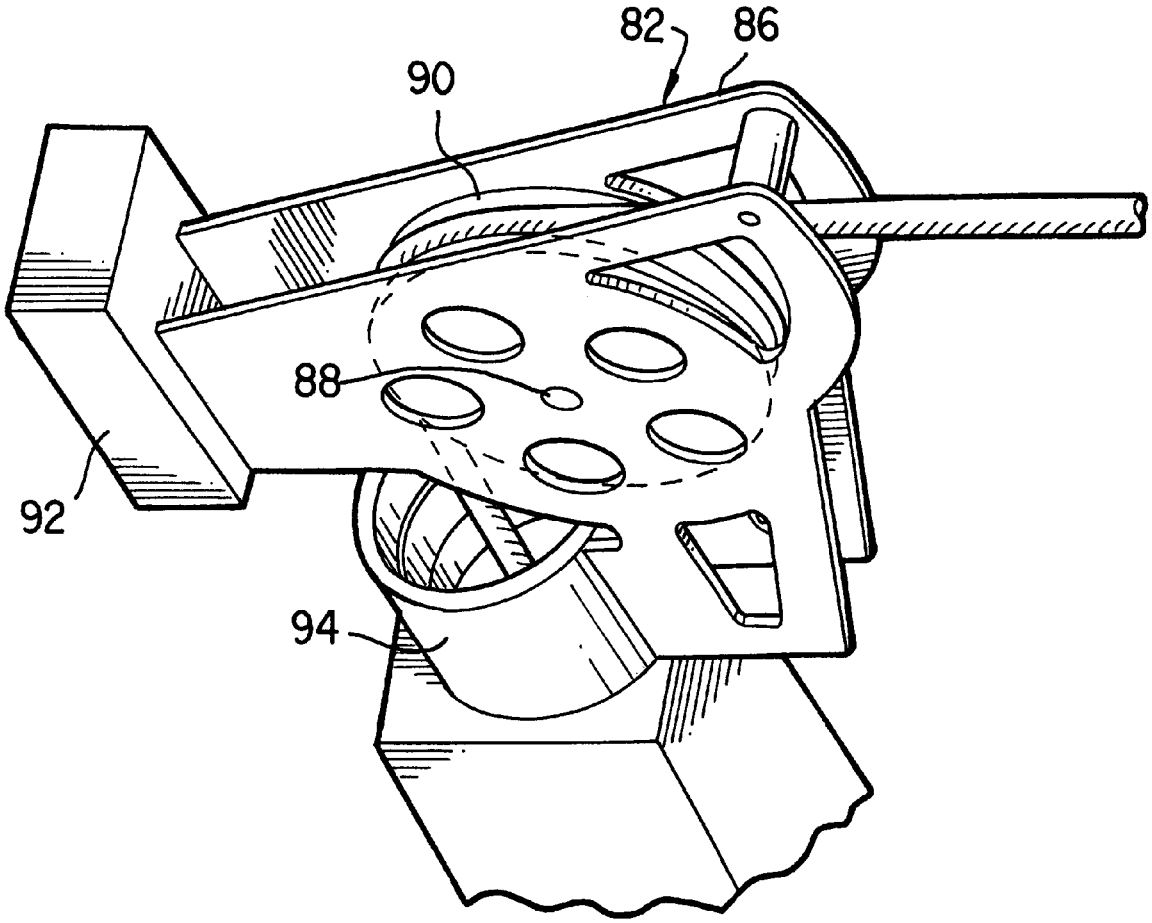
FIG. 4 is a perspective view of the pivoting pulley.
Figure 5:
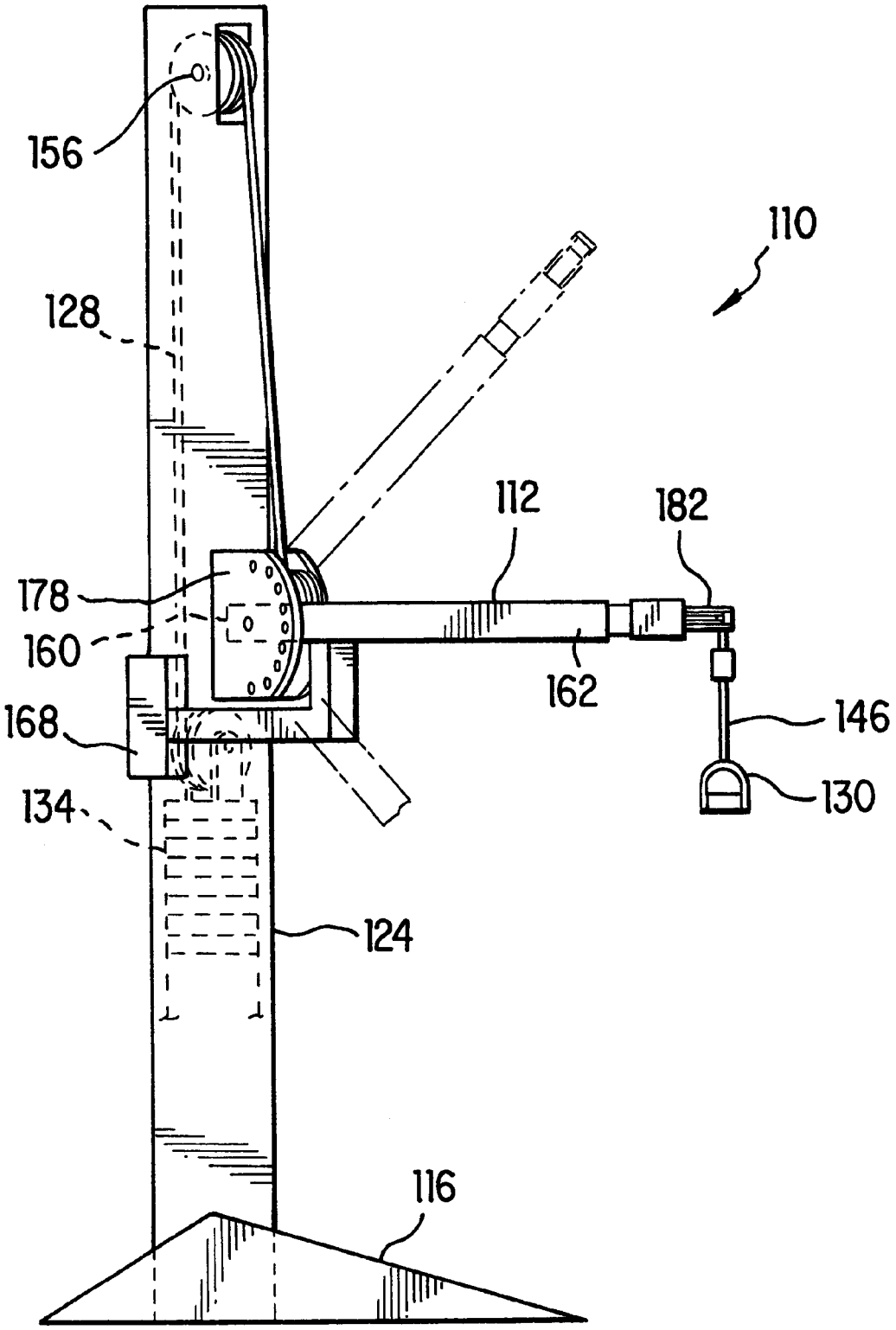
FIG. 5 is a side view of the cable crossover exercise apparatus in accordance with the present invention.
Figure 7:
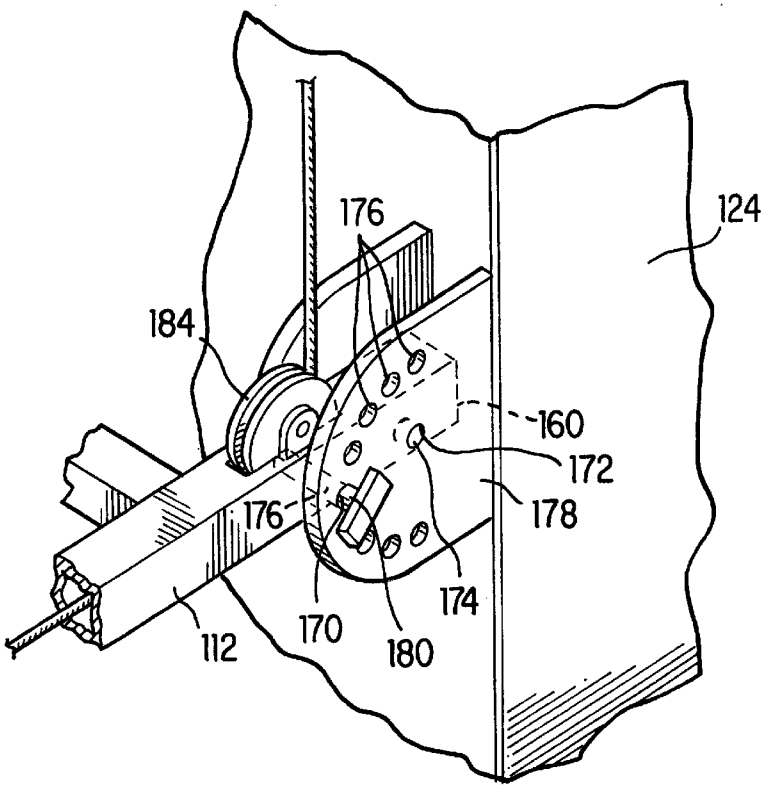
FIG. 7 is a detailed perspective view of the flange assembly of the cable crossover exercise apparatus.

The pivoting pulley 82 is shown in greater detail in FIG. 4. Each pivoting pulley 82 includes a frame 86 with a central pivot 88 for rotatably supporting a pulley member 90. The frame 86 is formed so as to cover the pulley member 90 and thereby prevent undesired access with the pulley member 90 as the cable 28 passes thereover. The frame 86 is further provided with a counterweight 92 opposite the pulley member 90.

The frame 86 further includes a cylindrical coupling member 94 shaped and dimensioned for pivotal attachment to the second end 62 of the first extension arm 12. The cylindrical coupling member 94 provides an opening through which the cable 28 passes as it extends from the extension arm 12 toward the pulley member 90. In this way, the cable 28 passes along the axis about which the pivoting pulley 82 pivots relative to the extension arm 12 to provide greater freedom of motion as an individual attempts to draw the cable 28 in various directions during exercise.

Since the pivoting pulley 82 permits a great degree of flexibility with regard to the angle at which the cable 28 is drawn from the extension arm 12 the inclusion of the present pivoting pulleys 82 at the distal end of each extension arm 12, 14 greatly increases the flexibility of the present exercise apparatus.

The respective ends of the first and second strands 46, 48 are each provided with stop members 96, 98. As those skilled in the art will readily appreciate, the stop members 96, 98 control motion of the single cable 28 to allow exercise by pulling the first strand 46 alone, the second strand alone 48, or both strands at the same time.

In use, and after the first and second extension arms are properly positioned in a desired orientation, the use stands upon the central member, grips the handles secure to the ends of the respective strands and performs desired lifting exercises.

With reference to FIGS. 5 to 8, a cable crossover exercise apparatus 110 is disclosed. As with the functional lift exercise apparatus 10, the cable crossover exercise apparatus 110 includes a pair of extension arms 112, 114 positioned to facilitate a wide range of lifting type exercises. In contrast to the functional lift exercise apparatus 10, and as will be discussed in greater detail below, the extension arms 112, 114 of the cable crossover 110 extend in opposite directions to provide the user with access to cable ends positioned for gripping when a user fully extends his or her arms outwardly in opposite directions.

The cable crossover exercise apparatus 110 includes a base structure 116 having a central support member 118 upon which a weight stack 124 is secured. In this way, the weight stack 124 forms the center of the cable crossover exercise apparatus 110 as the first and second extension arms 112, 114 extend outwardly away from the weight stack 124 in opposite directions.

As with the functional lift exercise apparatus 10, a single cable 128 links the user handles 130 to the weight stack 124. The cable 128 is run through a series of pulleys to provide a 4:1 load ratio for each handle. In this way, a four hundred pound weight stack may be moved by the application of one hundred pounds force at each handle 130 of the cable crossover 110 (two hundred pounds total force when both handles are used simultaneously).

Figure 6:
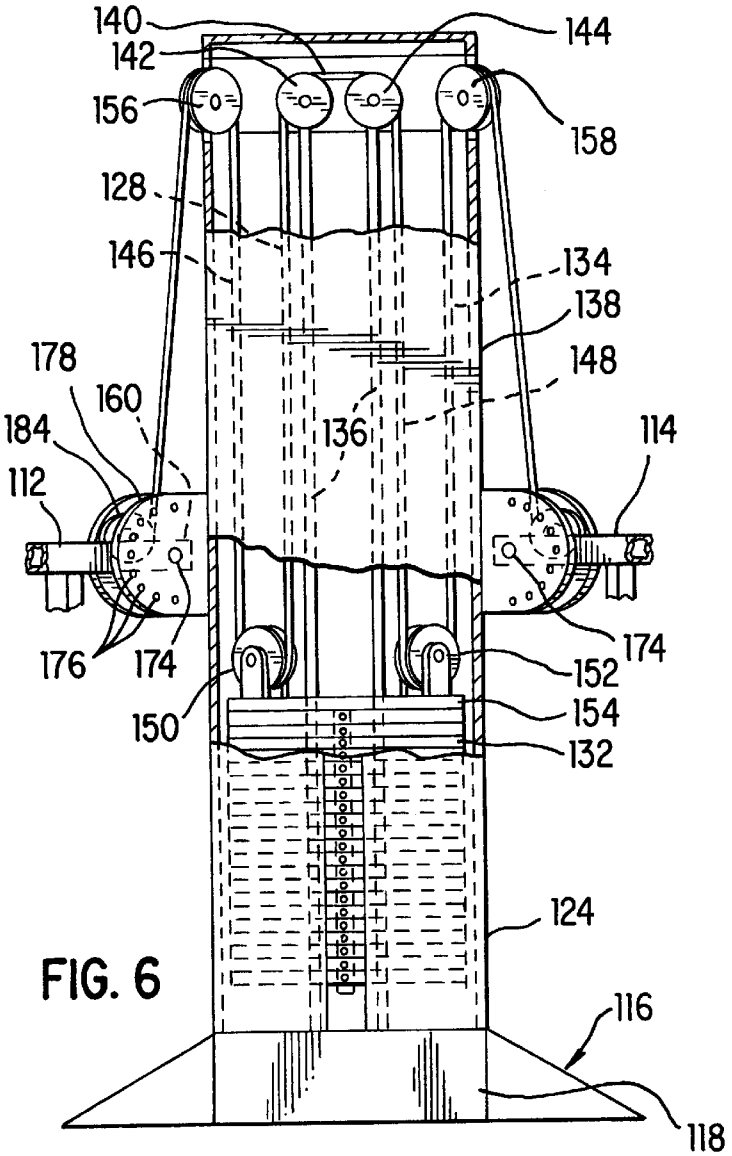
FIG. 6 is a front view of the cable crossover exercise apparatus with the weight stack shown in partial cross section.
Figure 8:
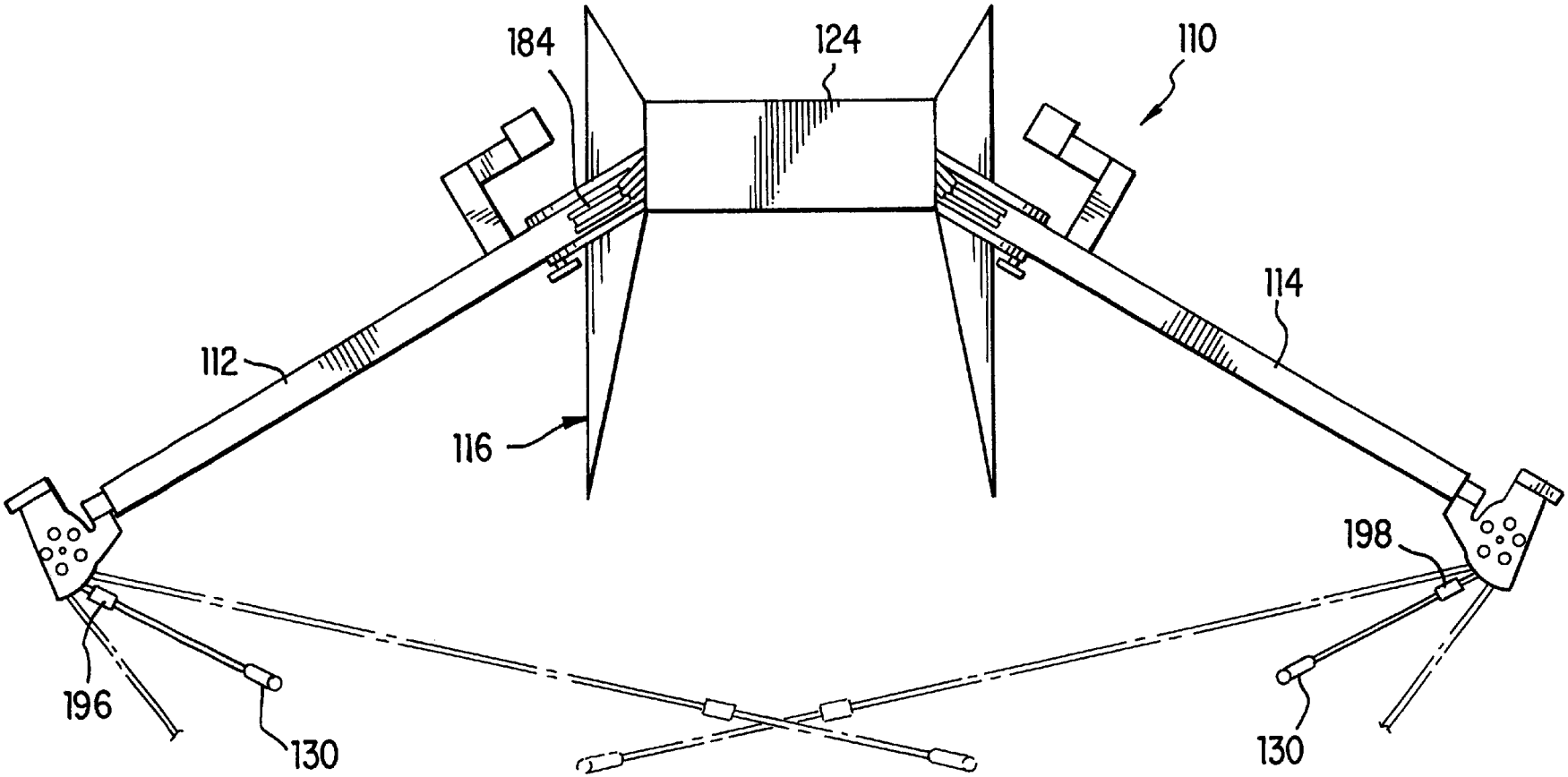
FIG. 8 is a top view of the cable crossover exercise apparatus.

With reference to FIG. 6, the weight stack 124 secured to the central support member 118 includes support frame 134 having vertical support members 136 aligned to support a stack of weight plates 132. The weight plates 132 are supported for movement up and down in a conventional manner. In fact, the pulley system, which is discussed below in greater detail, is used in lifting the weight plates 132. The weight stack 124 is covered by a protective sleeve 138 positioned thereabout.

When force is applied by the user, the cable 128 lifts the stack of weight plates 132. The central portion 140 of the cable 128 is passed over first and second central upper pulleys 142, 144. The central upper pulleys 142, 144 are positioned adjacent the upper end of the weight stack 124, although the exact positioning of the central upper pulleys 142, 144 may be varied without departing from the spirit of the present invention.

First and second strands 146, 148 of the cable 128 then extend downwardly within the weight stack 124 to respectively engage first and second movement pulleys 150, 152. The movement pulleys 150, 152 are attached to a coupling member 154 directly coupled to the stack of weight plates 132. In this way, upward movement of the movement pulleys 150, 152 causes the coupling member 154 to move upwardly, and ultimately lifts the weight plates 132 upwardly against the force of gravity.

The first and second strands 146, 148 then extend upwardly and respectfully pass over first and second exit pulleys 156, 158. After passing over the exit pulleys 156, 158, and exiting the confines of the weight stack 124, the opposite strands 146, 148 extend downwardly until they enter the first and second extension arms 112, 114 which are discussed below in greater detail. Although a preferred orientation is disclosed for the various pulleys used in accordance with the present invention, those skilled in the art will readily understand that the exact orientation of the pulleys may be varied without departing from the spirit of the present invention.

The first and second extension arms 112, 114 are pivotally coupled to a central portion of the weight stack 124 and extend outwardly from the central support member 118. The first and second extension arms 112, 114 respectively rotate about a first axis and a second axis, which are positioned to orient the first and second extension arms 112, 114 in an opposed relationship. Specifically, the first and second extension arm 112 and 114 extend toward a user at a slight angle relative to a vertical plane in which the weight stack 124 lies. In this way, the ends of the extension arms 112, 114 are moved from the stack to improve user access to the present apparatus 110 while exercising. As those skilled in the art will readily appreciate, the exact angular orientation of the arms is not critical and may be varied slightly without departing from the spirit of present invention.

The extension arms 112, 114 are substantially identical and will now be described with reference to the first extension arm 112. The first extension arm 112 includes a first end 160 and a second end 162. In accordance with the preferred embodiment of the present invention, each the first arm 112 is approximately 32 inches from pivot point 174 to the end of the table, although those skilled in the art will appreciate that the length of the first extension arm 112 may be varied slightly without departing from the spirit of the present invention.

The first extension arm 112 is pivotally coupled, at a position near the first end 160 of the extension arm 112, to a semicircular flange assembly 178 secured to the front of weight stack 124. The semicircular flange assembly 178 includes a pair of opposed flat plates and is mounted to lie within the plane in which the first extension arm 112 rotates as it moves relative to the weight stack 124. Movement of the first extension arm 112 is controlled by the inclusion of a counterweight 168 at the first end 160 of the first extension arm 112.

The first extension arm 112 is pivotally coupled in a manner allowing a user to select a desired orientation for the extension arm 112 and lock the extension arm 112 in place. Specifically, the first extension arm 112 includes a locking hole 170 located adjacent a pivot hole 172 through which a pivot pin 174 passes to pivotally couple the first extension arm 112 to the semicircular flange assembly 178, and ultimately, the weight stack 124. The locking hole 170 is aligned with a series of flange holes 176 formed in the semicircular flange assembly 178 of the weight stack 124.

In practice, and as those skilled in the art will readily appreciate, a locking pin 180 is passed though an aligned locking hole 170 and flange hole 176 to lock the first extension arm 112 at a desired angular orientation relative to the weight stack 124. When a user desires to change the angular orientation of the first extension arm 112, the locking pin 180 is simply removed and the locking hole 170 is aligned with another flange hole 176 at which time the locking pin 180 is once again inserted in position to lock the first extension arm 112 relative to the weight stack 124.

The second end 162 of the first extension arm 112 is fitted with a pivoting pulley 182 to guide the first strand 146 of the cable 128 as it exits the first extension arm 112. With reference to the prior discussion regarding the pulley assembly employed in accordance with the present invention, once the first strand 146 of the cable 128 pass over the exit pulley 156 and moves downwardly into engagement with the first extension arm 112, the first strand passes over a guide pulley 184 located at the first end 160 of the first extension arm 112. The first strand 146 of the cable 128 passes over the first guide pulley 184 and enters the tubular passageway formed in the first extension arm 112.

Figure 9:
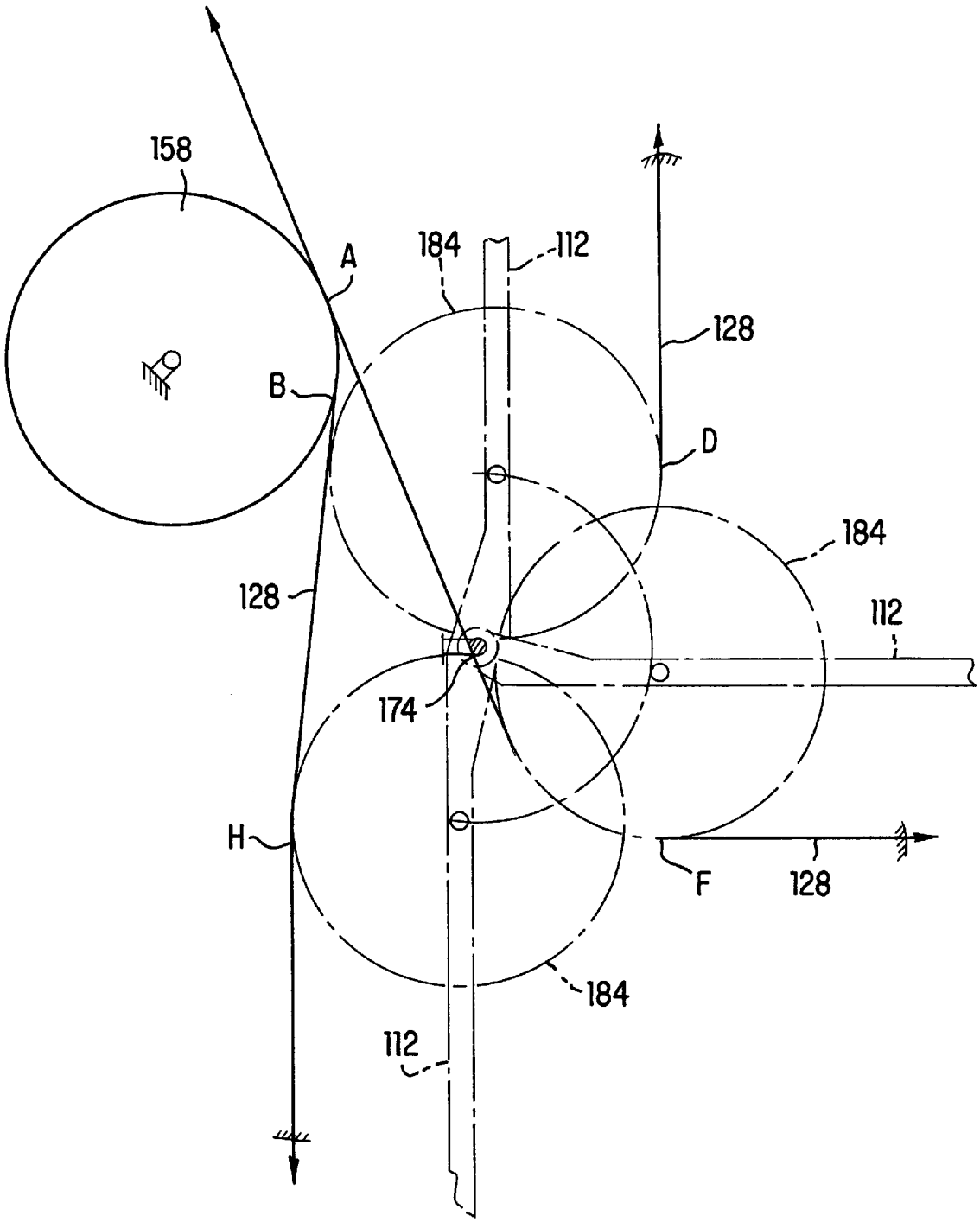
FIG. 9 is a schematic showing the relative orientation of cable guide pulley.

In an attempt to reduce the tightening or loosening of the cable 128 as the first extension arm 112 is rotated, the first guide pulley 184 is positioned to ensure that the cable tension does not vary as the extension arm 112 is rotated. Specifically, and with reference to FIG. 9, the first guide pulley 184 is positioned to ensure that A:D=A:F=A:H.

Upon reaching the second end 162 of the first extension arm 112, the first strand 146 passes over the pivoting pulley 182 and is ready for engagement by a user of the present apparatus 110. The distal end of each strand 146, 148 of the cable 112 may be fitted with a wide variety of handles 130 known to those skilled in the art.

The pivoting pulley 182 is substantially the same as that disclosed in FIG. 4 and discussed above in substantial detail. Since the pivoting pulley 182 permits a great degree of flexibility with regard to the angle at which the cable 128 is drawn from the first extension arm 112, the inclusion of the present pivoting pulley 182 at the distal end of each extension arm 112, 114 greatly increases the flexibility of the present exercise apparatus.

The respective ends of the first and second strands 146, 148 are each provided with stop members 196, 198. As those skilled in the art will readily appreciate, the stop members 196, 198 control motion of the single cable to allow exercise by pulling the first strand 146 alone, the second strand 148 alone, or both strands at the same time.

In use, and after the extension arms are properly positioned in a desired orientation, the user stands in front of the weight stack, grips the handles secure to the ends of the respective strands and performs desired lifting exercises.

While the preferred embodiments have been shown and described, it will be understood that there is no intent to limit the invention by such disclosure, but rather, is intended to cover all modifications and alternate constructions falling within the spirit and scope of the invention as defined in the appended claims.

What is claimed is:

1. An exercise apparatus, comprising:

a resistance assembly;

a cable linking a first extension arm and a second extension arm to the resistance assembly, wherein the cable includes a first strand and a second strand;

the first extension arm includes a first end selectively supported adjacent the resistance assembly and a free second end from which the first strand of the cable extends for engagement by a user;

the second extension arm includes a first end selectively supported adjacent the resistance assembly and a free second end from which the first strand of the cable extends for engagement by a user; and wherein the first extension arm extends away from the second extension arm, moving the second end of the first extension arm away from the second end of the second extension arm to define an extended opposed spacing of the first and second strands and the first end of the first extension arm is pivotally supported adjacent the resistance assembly at a first pivot point for rotation about a first axis, the first end of the first extension arm includes a pulley having an axis of rotation offset from the first pivot point and rotating about an axis substantially parallel to the first axis such that cable tension does not vary as the first extension arm is selectively rotated, and wherein the first end of the second extension arm is pivotally supported adjacent the resistance assembly at a second pivot point for rotation about a second axis, the first end of the second extension arm includes a pulley having an axis of rotation offset from the second pivot point and rotating about an axis substantially parallel to the second axis such that cable tension does not vary as the second extension arm is selectively rotated.

2. The exercise apparatus according to claim 1, wherein the cable consists essentially of a single cable.

3. The exercise apparatus according to claim 1, wherein the first extension arm is pivotally supported adjacent the resistance assembly and the second extension arm is pivotally supported adjacent the resistance assembly.

4. The exercise apparatus according to claim 3, wherein the first extension arm is pivotally coupled to the resistance assembly and the second extension arm is pivotally coupled to the resistance assembly.

5. The exercise apparatus according to claim 3, further including first locking means for selectively locking the first extension arm in position relative to the resistance assembly and second locking means for selectively locking the second extension arm in position relative to the resistance assembly.

6. The exercise apparatus according to claim 3, wherein the first extension arm pivots about a first axis and the second extension arm pivots about a second axis, and the first axis and the second axis are positioned to orient the first and second extension arms in an opposed relationship.

7. The exercise apparatus according to claim 1, wherein the first extension arm is approximately 32 inches long and the second extension arm is approximately 32 inches long.

8. An exercise apparatus, comprising:

a resistance assembly;

a cable linking a first extension arm and a second extension arm to the resistance assembly, wherein the cable includes a first strand and a second strand;

the first extension arm includes a first end selectively supported adjacent the resistance assembly and a free second end from which the first strand of the cable extends for engagement by a user;

the second extension arm includes a first end selectively supported adjacent the resistance assembly and a free second end from which the first strand of the cable extends for engagement by a user; and wherein the first extension arm and the second extension are substantially parallel as they extend from the resistance assembly and the first end of the first extension arm is pivotally surpported adjacent the resistance assembly at a first pivot point for rotation about a first axis, the first end of the first extension arm includes a pulley having an axis of rotation offset from the first pivot point and rotating about an axis substantially parallel to the first axis such that cable tension does not vary as the first extension arm is selectively rotated; and wherein the first end of the second extension arm is pivotally supported adjacent the resistance assembly at a second pivot point for rotation about a second axis, the first end of the second extension arm includes a pulley having an axis of rotation offset from the second pivot point and rotating about an axis substantially parallel to the second axis such that cable tension does not vary as the second extension arm is selectively rotated.

9. The exercise apparatus according to claim 8, wherein the cable consists essentially of a single cable.

10. The exercise apparatus according to claim 8, wherein the first extension arm is pivotally supported adjacent the resistance assembly and the second extension arm is pivotally supported adjacent the resistance assembly.

11. The exercise apparatus according to claim 10, wherein the first extension arm is pivotally coupled to the resistance assembly and the second extension arm is pivotally coupled to the resistance assembly.

12. The exercise apparatus according to claim 10, further including first locking means for selectively locking the first extension arm in position relative to the resistance assembly and second locking means for selectively locking the second extension arm in position relative to the resistance assembly.

13. The exercise apparatus according to claim 10, wherein the first extension arm pivots about a first axis and the second extension arm pivots about a second axis, and the first axis is substantially aligned with the second axis.

14. The exercise apparatus according to claim 8, wherein the first extension arm is approximately 32 inches long and the second extension arm is approximately 32 inches long.

15. An exercise apparatus, comprising:

a resistance assembly;

a cable linking a first extension arm and a second extension arm to the resistance assembly, wherein the cable includes a first strand and a second strand;

the first extension arm includes a first end selectively supported adjacent the resistance assembly and a free second end from which the first strand of the cable extends for engagement by a user;

the second extension arm includes a first end selectively supported adjacent the resistance assembly and a free second end from which the first strand of the cable extends for engagement by a user; and wherein the first extension arm is pivotally supported adjacent the resistance assembly and the second extension arm is pivotally supported adjacent the resistance assembly and the first end of the first extension arm is pivotally supported adjacent the resistance assembly at a first pivot point for rotation about a first axis, the first end of the first extension arm includes a pulley having an axis of rotation offset from the first pivot point and rotating about an axis substantially parallel to the first axis such that cable tension does not vary as the first extension arm is selectively rotated; and wherein the first end of the second extension arm is pivotally supported adjacent the resistance assembly at a second pivot point for rotation about a second axis, the first end of the second extension arm includes a pulley having an axis of rotation offset from the second pivot point and rotating about an axis substantially parallel to the second axis such that cable tension does not vary as the second extension arm is selectively rotated.

16. The exercise apparatus according to claim 15, wherein the cable consists essentially of a single cable.

17. The exercise apparatus according to claim 15, wherein the first extension arm is pivotally coupled to the resistance assembly and the second extension arm is pivotally coupled to the resistance assembly.

18. The exercise apparatus according to claim 15, further including first locking means for selectively locking the first extension arm in position relative to the resistance assembly and second locking means for selectively locking the second extension arm in position relative to the resistance assembly.

19. The exercise apparatus according to claim 15, wherein the first extension arm pivots about a first axis and the second extension arm pivots about a second axis, and the first axis is substantially parallel to the second axis.

20. An exercise apparatus, comprising:

a resistance assembly;

a cable linking a first extension arm and a second extension arm to the resistance assembly, wherein the cable includes a first strand and a second strand;

the first extension arm includes a first end pivotally supported adjacent the resistance assembly at a first pivot point rotating about a first axis and a free second end from which the first strand of the cable extends for engagement by a user, the first end of the first extension arm further including a pulley having an axis of rotation offset from the first pivot point and rotating about an axis substantially parallel to the first axis such that cable tension does not vary as the first extension arm is selectively rotated;

the second extension arm includes a first end pivotally supported adjacent the resistance assembly at a second pivot point rotating about a second axis and a free second end from which the first strand of the cable extends for engagement by a user, the first end of the second extension arm further including a pulley having an axis of rotation offset from the second pivot point and rotating about an axis substantially parallel to the first axis such that cable tension does not vary as the second extension arm is selectively rotated.

* * * * *

UNITED STATES PATENT AND TRADEMARK OFFICE

CERTIFICATE OF CORRECTION

PATENT NO. : 6,238,323 B1
DATED : May 29, 2001
INVENTOR(S) : Roy Simonson

It is certified that error appears in the above-identified patent and that said Letters Patent is hereby corrected as shown below:

Title page,
Assignee, please change "RLLLP" to -- Ground Zero Design Corporation --

ABSTRACT
Line 1, please change "apparatuses" to -- apparatus --

Column 2,
Line 1, please change "first strand" to -- second strand --
Line 9, please change "extension are" to -- extension arm are --

Column 7,
Line 31, please change "cable 112" to -- cable 128 --

Column 8,
Lines 3 and 61, please change "first strand" to -- second strand --
Line 17, please change "rotated, and" to -- rotated; and --
Line 63, please change "second extension" to -- second extension arm --

Column 9,
Line 49, please change "first strand" to -- second strand --

Column 10,
Line 48, please change "first strand" to -- second strand --

Signed and Sealed this

Seventh Day of May, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,238,323 B1
DATED : May 29, 2001
INVENTOR(S) : Roy Simonson

It is certified that error appears in the above-identified patent and that said Letters Patent is hereby corrected as shown below:

Column 2,
Line 41, after "of" insert -- a --

Column 5,
Line 18, change "use" to -- user --
Line 19, change "secure" to -- secured --

Column 6,
Line 27, change "arm" to -- arms --

Column 7,
Line 14, change "pass" to -- passes --
Line 49, change "secure" to -- secured --

Column 8,
Line 66, after "pivotally" change "surpported" to -- supported --

Column 10,
Line 52, change "first axis" to -- second axis --

Signed and Sealed this

Eleventh Day of March, 2003

JAMES E. ROGAN
*Director of the United States Patent and Trademark Office*